United States Patent [19]

Hirose

[11] 4,065,993

[45] Jan. 3, 1978

[54] ELECTRONIC ORGAN WITH A THREE-FINGER CHORD AND ONE-FINGER AUTOMATIC CHORD PLAYING MODE SELECTOR

[75] Inventor: Yasunori Hirose, Hamamatsu, Japan

[73] Assignee: Nippon Gakki Seizo Kabushiki Kaisha, Japan

[21] Appl. No.: 642,670

[22] Filed: Dec. 19, 1975

[30] Foreign Application Priority Data

| | | |
|---|---|---|
| Dec. 26, 1974 | Japan | 49-148363 |
| Feb. 6, 1975 | Japan | 50-17169 |
| Apr. 3, 1975 | Japan | 50-45185 |

[51] Int. Cl.[2] ..... G10F 1/00

[52] U.S. Cl. ..... 84/1.03; 84/DIG. 22

[58] Field of Search ..... 84/1.01, 1.03, 1.17, 84/1.24, DIG. 22, DIG. 25, DIG. 2, DIG. 12; 307/239, 248, 253-254

[56] References Cited

U.S. PATENT DOCUMENTS

| | | | |
|---|---|---|---|
| 3,708,602 | 1/1973 | Hiyama | 84/1.03 |
| 3,708,604 | 1/1973 | Hebeisen et al. | 84/1.03 |
| 3,711,618 | 1/1973 | Freeman | 84/1.03 |
| 3,712,950 | 1/1973 | Freeman | 84/1.03 |
| 3,715,442 | 2/1973 | Freeman | 84/1.01 |
| 3,766,305 | 10/1973 | Schrecongost | 84/1.01 |
| 3,825,667 | 7/1974 | Schrecongost | 84/1.01 |
| 3,844,192 | 10/1974 | Brand et al. | 84/1.01 |
| 3,921,491 | 11/1975 | Freeman | 84/1.01 |
| 3,954,039 | 5/1976 | Southard | 84/1.01 |
| 4,000,674 | 1/1977 | Schreier | 84/1.01 |

*Primary Examiner*—Robert K. Schaefer
*Assistant Examiner*—Vit W. Miska
*Attorney, Agent, or Firm*—Flynn & Frishauf

[57] ABSTRACT

An electronic organ provided with a selector for selecting a three-finger chord playing mode or a one-finger chord playing mode. When the three-finger chord playing mode is selected, a chord is sounded by three or four fingers on a manual keyboard or lower keyboard as in the conventional electronic organ. On the other hand, when the one-finger chord playing mode is selected, there can be automatically sounded one of chord types, such as major, minor, seventh and minor seventh chords, which have, as the root note, the note of a key being actuated on the manual keyboard. The selection of a chord type is effected by a pedal keyboard.

23 Claims, 4 Drawing Figures

ELECTRONIC ORGAN WITH A THREE-FINGER CHORD AND ONE-FINGER AUTOMATIC CHORD PLAYING MODE SELECTOR

BACKGROUND OF THE INVENTION

This invention relates to an electronic organ. In an electronic organ with upper and lower manual keyboards and a pedal keyboard, the melody is played by the upper keyboard, the chords by the lower keyboard, and the bass notes by the pedal keyboard. The chord should be played rhythmically to the melody. A beginner is not good at chord playing, and cannot fully enjoy playing an electronic organ with which chord playing is possible. If the electronic organ is so modified that chord playing can be made merely by depressing a single key on the lower keyboard in order to enable the beginner to enjoy chord playing, it becomes problematical for an advanced player who wishes to play a chord using three or four fingers.

SUMMARY OF THE INVENTION

Accordingly the object of this invention is to provide an electronic organ with which it is possible to perform selectively chord playing using three or four fingers and chord playing using one finger.

The electronic organ embodying this invention has a three-finger chord playing section (this section is for playing a chord by depressing individual keys of the chord constituent notes, usually by three fingers and sometimes by four or other number of fingers), a one-finger chord playing section, and a selector switch which couples selectively one of these sections to a sound producing means comprised of a loudspeaker and an appropriate amplifier. The three-finger chord playing section includes keyers for deriving from tone generators tone signals having the note or notes of a key or keys which are actuated on a manual keyboard. The one-finger chord playing section includes an automatic chord constituting means for selectively deriving from the tone generators tone signals of notes constituting a chord whose root note is the note of a single key which is actuated on the manual keyboard.

The automatic chord constituting means may include a chord gate means for deriving from the tone generators tone signals constituting a plurality of chords containing the root note and a chord type selecting means for selecting one of the chord types constituted by the tone signals from the chord gate means.

The chord type selecting means selects one chord type among major, minor, seventh and minor seventh chords, in response to a pedal keyboard depression. For example, a major chord is selected when neither the natural nor sharp pedals of the pedal keyboard are actuated, a seventh chord is selected when only the natural pedal on pedals are actuated, a minor chord is selected when only the sharp pedal on pedals are actuated, and a minor seventh chord is selected when both the natural and sharp pedals are actuated.

The tone signals derived by the three-finger chord play or the tone signals derived by the one-finger chord play may be coupled to the sound producing means through a rhythm gate means which is enabled in a rhythm pattern.

The automatic chord constituting means may include a root note detector which causes, when a chord is played or a single key is actuated on the manual keyboard, the aforementioned chord gate means to derive tone signals containing the root note of the chord being played or the note of the single key as the root note. In the case the one-finger chord playing section is selected by the selector switch, the root note detector is so controlled, if a plurality of keys are actuated on the manual keyboard, as to cause the chord gate means to derive tone signals which contain as the root note the lowest note or the highest note of the keys being actuated according to the circuit design.

Further, according to this invention, root and fifth note tone signals from the chord gate means, which are common to a plurality of chord types having the same root note, are alternately coupled to the sound producing means through a frequency divider which is adapted to produce a bass note. The bass note may be sounded in a rhythm pattern by a bass gate.

DETAILED DESCRIPTION OF THE PREFERRED EMBODIMENTS

Figure 1:
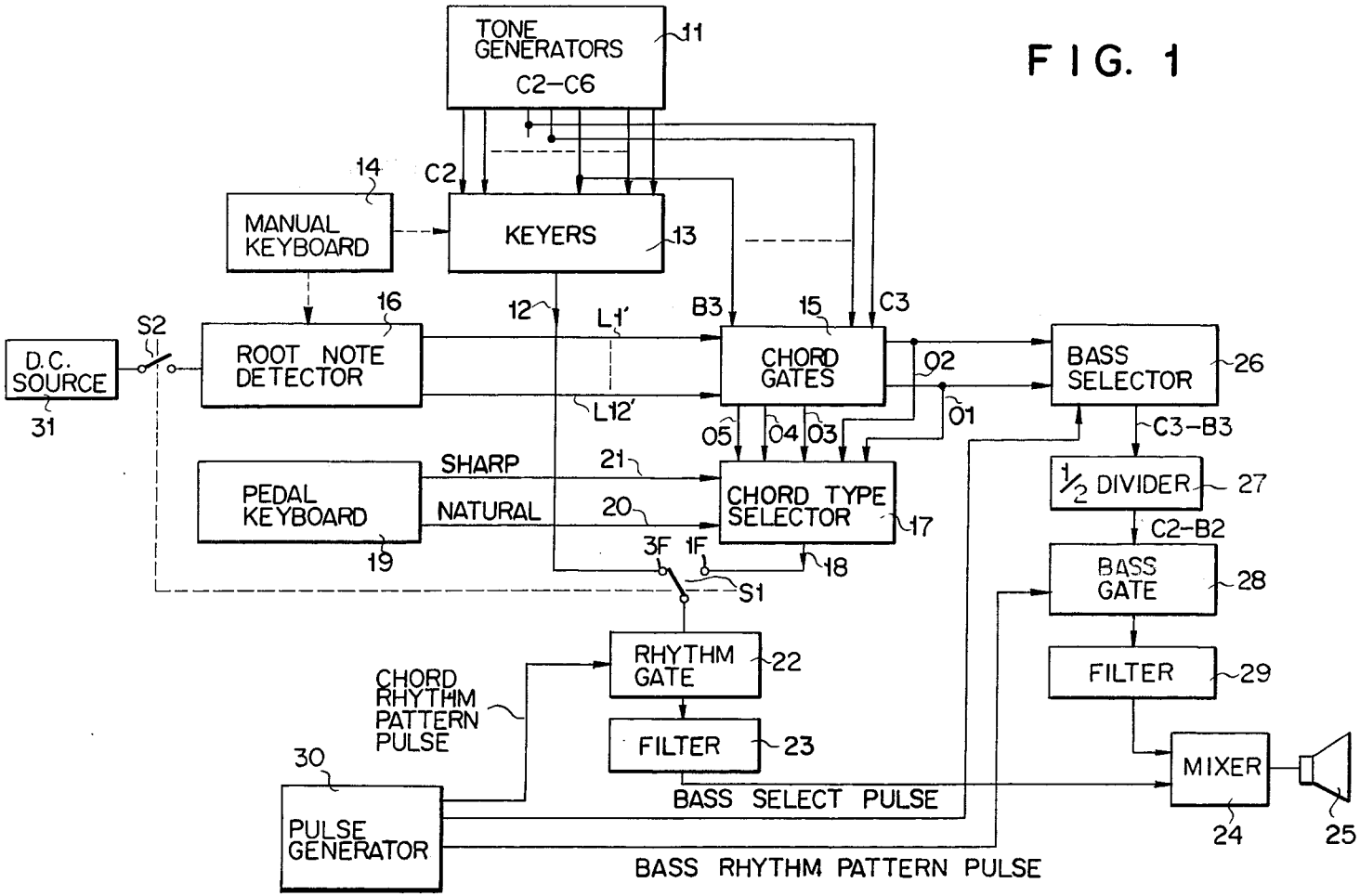
FIG. 1 is a block diagram of an embodiment of this invention.

In FIG. 1, reference numeral 11 denotes tone generators which may produce notes C2 to C6. The tone signals from the tone generators 11 are derived to the output line 12 of conventional keyers 13 which are actuated by a manual keyboard or lower keyboard 14. One-octave notes, for example, C3 to B3, from the tone generators 11 are coupled to a chord gate circuit 15.

The manual keyboard 14 is associated with a root note detector 16, which detects, when a chord is played on the manual keyboard 14, the root note of the chord. The root note detector 16 has 12 output lines L1′ to L12′ corresponding respectively to twelve notes of one octave, and upon detection of one root note it produces an output at the output line which corresponds to the detected root note. Similarly, the chord gate circuitry 15 has 12 gates, each coupled with five notes which can constitute major, minor, seventh and minor seventh chords having the same root note. When an output appears on one output line of the root note detector 16, the chord gate coupled to the output line is enabled to couple five notes coupled thereto, i.e. root note, fifth note, minor third note, major third note and minor seventh note to five output lines 01, 02, 03, 04 and 05 of the chord gate circuit 15, respectively.

The output lines 01 to 05 of the chord gate circuit 15 are coupled to a chord type selector 17 with an output line 18. The chord type selector 17 couples to the output line 18 three or four of the five notes from the chord gate circuit 15 in response to the depressing mode of a pedal keyboard 19, thereby selecting one of the four chord types which can be constituted by the notes from among the five notes from the chord gate circuit 15.

The pedal keyboard 19 has two output lines 20 and 21 which are coupled to the chord type selector 17. It provides the output line 20 with an output when a natural pedal or pedals are actuated and the output line 21 with an output when a sharp pedal or pedals are actuated. The chord type selector 17 selects a major chord constituted by root, fifth, and major third notes when, for example, neither the natural nor sharp pedals are actuated on the pedal keyboard 19, a seventh chord constituted by root, fifth, major third and minor seventh notes when, for example, only the natural pedal or pedals are actuated, a minor chord constituted by root, fifth and minor third notes when, for example, only the sharp pedal or pedals are actuated, or a minor seventh chord constituted by root, fifth, minor third and minor seventh notes when both the natural and sharp pedals are actuated concurrently. Any selected chord tones are coupled to the output line 18.

The output line 12 of the keyers 13 and the output line 18 of the chord type selector 17 are connected respectively to fixed contacts 3F and 1F of a single-pole double-throw switch S1, respectively. While the movable contact of the switch S1 is thrown to terminal 3F as shown in FIG. 1, playing can be performed using three or four or more fingers. While the movable contact is thrown to the other terminal 1F, chord playing can be effected using only one finger. The movable contact of the switch S1 is coupled through a rhythm gate 22, a tone coloring filter 23 and a mixer 24 to a loudspeaker 25.

Two notes commonly contained in all of the chords, that is, the root note and fifth note are coupled from the chord gate circuit 15 to a bass selector 26. The bass selector 26 couples alternately the root note and the fifth note to the loudspeaker 25 through a ½ frequency divider 27, a bass gate 28 and a tone coloring filter 29, thereby sounding alternately two bass notes which agree with the chord playing.

Figure 4:
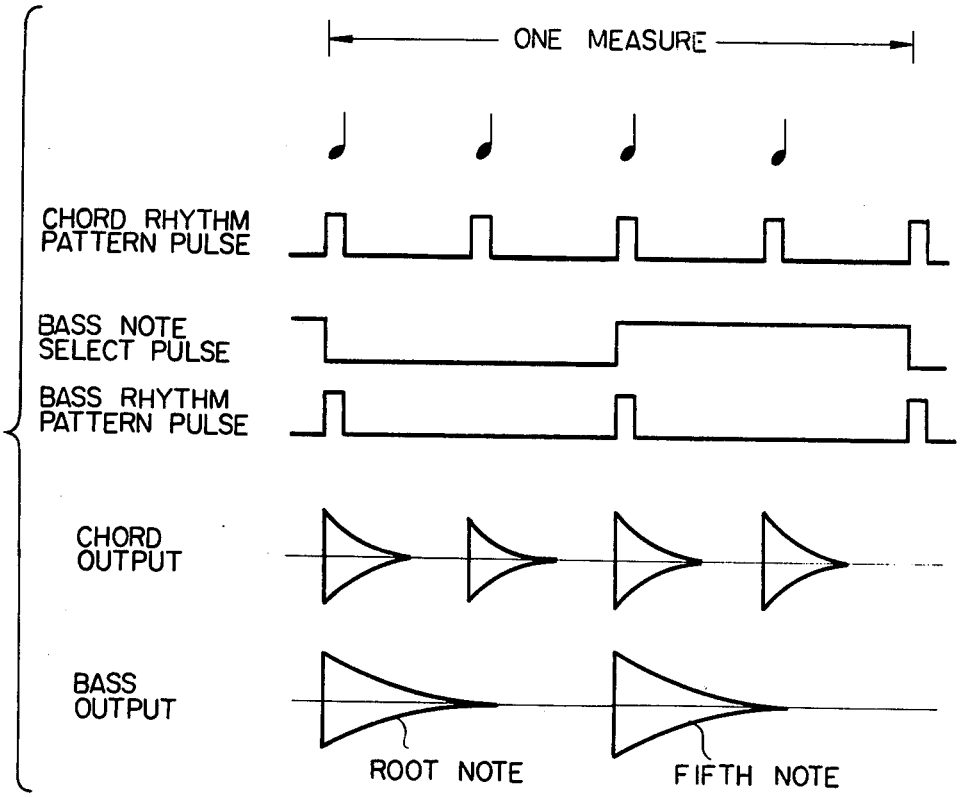
FIG. 4 shows the waveforms of chord rhythm pattern pulse, bass note select pulse, bass rhythm pattern pulse, chord output and bass output with respect to one measure.

The chord rhythm gate 22, the bass selector 26 and the bass gate 28 are enabled respectively by a chord rhythm pattern pulse, a bass select pulse and a bass rhythm pattern pulse which are generated by a conventional rhythm pattern pulse generator 30. These three pulse trains, the output of the chord rhythm gate 22 and the output of the bass gate 28, all corresponding to 4/4 time, have, for example, such waveforms as illustrated in FIG. 4. As shown in FIG. 4, it is desirable that both the chord rhythm gate 22 and the bass gate 28 have a percussive envelope providing function.

Whichever chord playing mode, conventional or one-finger, is selected by the selector switch S1, the root note detector 16 detects the root note of a chord to provide an output on the output line corresponding to the root note when the chord is played on the keyboard 14 and provides an output on the output line corresponding to the note of a single key, when it is actuated on the keyboard 14. In order to detect the root note of any chord being played on the manual keyboard 14, the root note detector 16 is provided with means for prohibiting the detection of any notes lower than the root note and with means for detecting preferentially the root note, i.e. the lowest note of all the detected notes. If the switch S1 is so thrown as to select the one-finger chord playing mode, however, it is preferable to predetermine which key should be detected in case two or more keys were actuated on the manual keyboard 14 at the same time. To this end, a switch S2 which is ganged with the switch S1 and closes when the switch S1 is thrown to select the one-finger chord playing mode is employed to couple a D.C. source 31 to the root note detector 16. Consequently, when the D.C. source is coupled to the root note detector 16, the means for prohibiting the detection of notes lower than the root is released so that the root note detector 16 detects the lowest note preferentially. Also in this case, if a single key is actuated on the manual keyboard 14, an output appears at the output line corresponding to the note of the actuated key.

Figure 2:
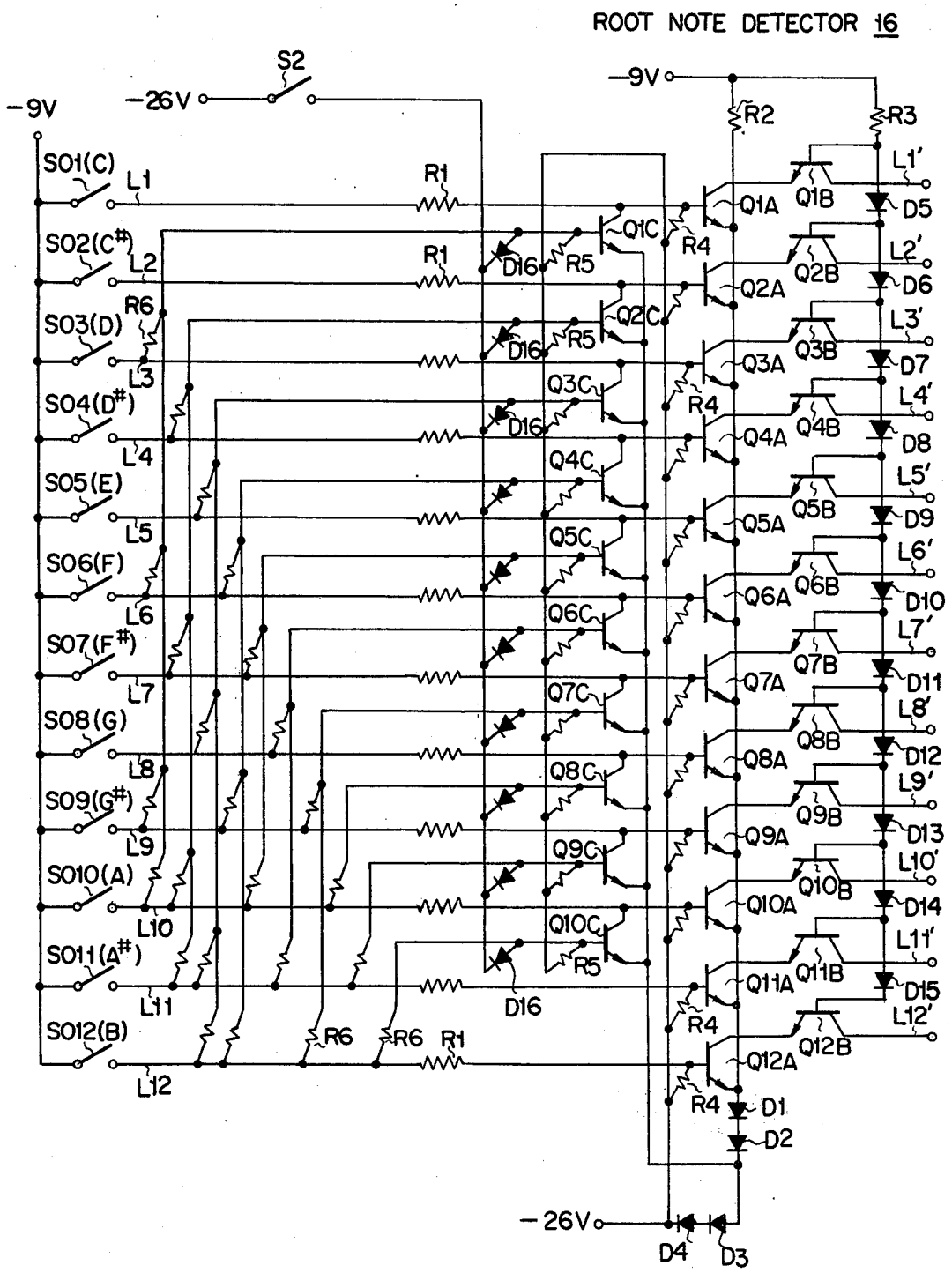
FIG. 2 shows an exemplary circuit of the root note detector of the embodiment of FIG. 1.

An embodiment of the root note detector 16 will now be explained in detail with reference to FIG. 2. The root note detector 16 has 12 input lines L1 to L12 corresponding respectively to the aforementioned output lines L1' to L12', which correspond to 12 notes, i.e. C, C#, D, D#. . . A, A#, and B, respectively. These input lines L1 to L12 are connected to one end to a −9V power source respectively through key switches S01 to S012 which are actuated by the keys (not shown) of the manual keyboard 14. The key switches S01 to S012 are to be actuated each by the key of the corresponding note. For instance, the key switch S01 is actuated by the key of note C. Though not shown, key switches to be actuated by the keys of notes C2, C3, C4, C5 and C6 on the manual keyboard may be connected parallel to each other. Namely, the key switches which are to be actuated by the corresponding keys spaced by one-octave may be connected in parallel.

The input lines L1 to L12 are coupled at the other end respectively to the bases of transistors Q1A to Q12A through resistors R1. The emitters of the transistors Q1A to Q12A are connected to a −26V power source via diodes D1, D2, D3 and D4, and also to a −9V power source via a resistor R2. Between the output lines L1' to L12' and the collectors of the transistors Q1A to Q12A are connected the emitter-collector paths of transistors Q1B to Q12B, respectively. The bases of the transistors Q1B to Q12B are connected respectively to the junctions of a series connection of diodes D5 to D15 and a resistor R3, which is connected at one end to the −9V power source.

The bases of the transistors Q1A to Q12A are coupled to the −26V power source respectively through resistors R4, and the bases of the transistors Q1A to Q10A are coupled to the junction between the diodes D2 and D3 through the collector-emitter paths of transistors Q1C to Q10C, respectively. The bases of the transistors Q1C to Q10C are connected to the −26V power source respectively through resistors R5, and further to the aforementioned switch S2 respectively through diodes D16. Still further, the base of the transistor Q1C is connected to the input lines L3, L6, L9 and L10 through resistors R6, respectively. Similarly, the base of the transistor Q2C is connected to the input lines L4, L7, L10 and L11 through other resistors R6, the base of the transistor Q3C to the input lines L5, L8, L11 and L12 through resistors R6, the base of the transistor Q4C to the input lines L6, L9 and L12, the base of the transistor Q5C to the input lines L7 and L10, the base of the transistor Q6C to the input lines L8 and L11, the base of transistor Q7C to the input lines L9 and L12, the base of the transistor Q8C to the input line L10, the base of the transistor Q9C to the input line L11, and the base of the transistor Q10C to the input line L12 through respective resistors R6.

The combination of the resistors R5 and R6 and the transistors Q1C to Q10C serves to prohibit the detection of the notes lower than the root note. On the other hand, the resistors R2, R3 and R4, the transistors Q1A to Q12A, the transistors Q1B to Q12B and the diodes D5 to D15 constitute a lowest note preference circuit.

The root note detector 16, being constructed as mentioned above, functions in the following manner. If, for example, C major chord comprised of C, E, G notes is played on the manual keyboard 14, the key switches S01, S05 and S08 are closed, thus applying −9V on the input lines L1, L5 and L8. Then the base-emitter junctions of the transistors Q1A, Q5A and Q8A are forward-biased, and these transistors are made conductive. Once rendered conductive, the transistors Q1A has its collector potential lowered nearly to −26V. As a result, the base-emitter junction of the transistor Q1B is forward-biased, thereby lowering the base potential of the transistor Q1B nearly to −26V. Upon the potential drop at the base of the transistor Q1B, the base-emitter junctions of the transistors Q5B and Q8B can not be forward-biased. Consequently, if the keys of notes C, E and G are actuated, only the transistor Q1B is made conductive to apply nearly −26V on only the output line L1', whereby C note, i.e. the root note of C major chord is detected.

If, for another example, F minor chord (F, G#, C) is played on the manual keyboard 14, the key switches S01, S06 and S09 are closed to apply −9V on the input lines L1, L6 and L9. −9V applied on the input line L6 renders conductive the transistor Q1C coupled to the input line L1. Once made conductive, the transistor Q1C lowers the base potential of the transistor Q1A nearly to −26V, thus preventing the conduction of the transistor Q1A. The transistors Q6A and Q9A, however, are rendered conductive by −9V applied on the input lines L6 and L9. Of the transistors Q6B and Q9B, coupled respectively to the transistors Q6A and Q9A, only the transistors Q6B, whose base is connected nearer to the −9V power source, is made conductive. In consequence, a detection output of nearly −26V appears only on the output line L6' which corresponds to the root note F of the F minor chord.

If, for still another example, G seventh chord (G, B, D, F) is played on the manual keyboard 14, the key switches S03, S06, S08 and S012 are closed to render conductive the transistor Q3C the base of which is connected to the input lines L8 and L12 and the transistor Q6C the base of which is connected to the input line L8. As a result, the transistors Q3A and Q6A cannot be made conductive, but the transistors Q8A and Q12A are rendered conductive. Of the transistors Q8B and Q12B, however, only the transistor Q8B, whose base is connected nearer to the −9V power source, is rendered conductive. In consequence, an output appears only on the output lines L8' which corresponds to note G, i.e. the root note of G seventh chord.

As mentioned above, if any one of major, minor seventh and minor seventh chords is played, the root note of the chord can be detected by the root note detector 16. It will be apparent that if a single key is actuated on the manual keyboard 14, an output will appear on the output line which corresponds to the note of the actuated key.

The diodes D16 and the −26V power source are provided in order to disable the transistors Q1C to Q10C when the switch S2 is closed, no matter which chord is being played on the manual keyboard 14. For this reason, when a plurality of keys are actuated, the lowest note is preferentially detected. Of course, the root note detector 16 may be so designed as not to detect any note higher than the root note and to detect preferentially the highest note of all the detectable notes.

The chord gate circuitry 15, the chord type selector 17, the pedal keyboard 19 and the bass selector 26 will now be explained in detail with reference to FIG. 3.

As mentioned above, the chord gate circuit 15 has 12 gates which are coupled to the output lines L1' to L12' of the root note detector 16, respectively. Each of these gates is supplied with five notes from the tone generators 11. The combination of notes to each gate or each output line of the root note selector 16 is as listed below:

| Root Note Detector Outputs | Notes |
|---|---|
| L1' (C) . . . | A#3,E3,D#3,G3,C3 |
| L2' (C#) . . . | B3,F3,E3,G#3,C#3 |
| L3' (D) . . . | C3,F#3,F3,A3,D3 |
| L4' (D#) . . . | C#3,G3,F#3,A#3,D#3 |
| L5' (E) . . . | D3,G#3,G3,B3,E3 |
| L6' (F) . . . | D#3,A3,G#3,C3,F3 |
| L7' (F#) . . . | E3,A#3, A3,C#3,F#3 |
| L8' (G) . . . | F3,B3,A#3,D3,G3 |
| L9' (G#) . . . | F#3,C3,B3,D#3,G#3 |
| L10' (A) . . . | G3,C#3,C3,E3,A3 |
| L11' (A#) . . . | G#3,D3,C#3,F3,A#3 |
| L12' (B) . . . | A3,D#3,D3,F#3,B3 |

Figure 3:
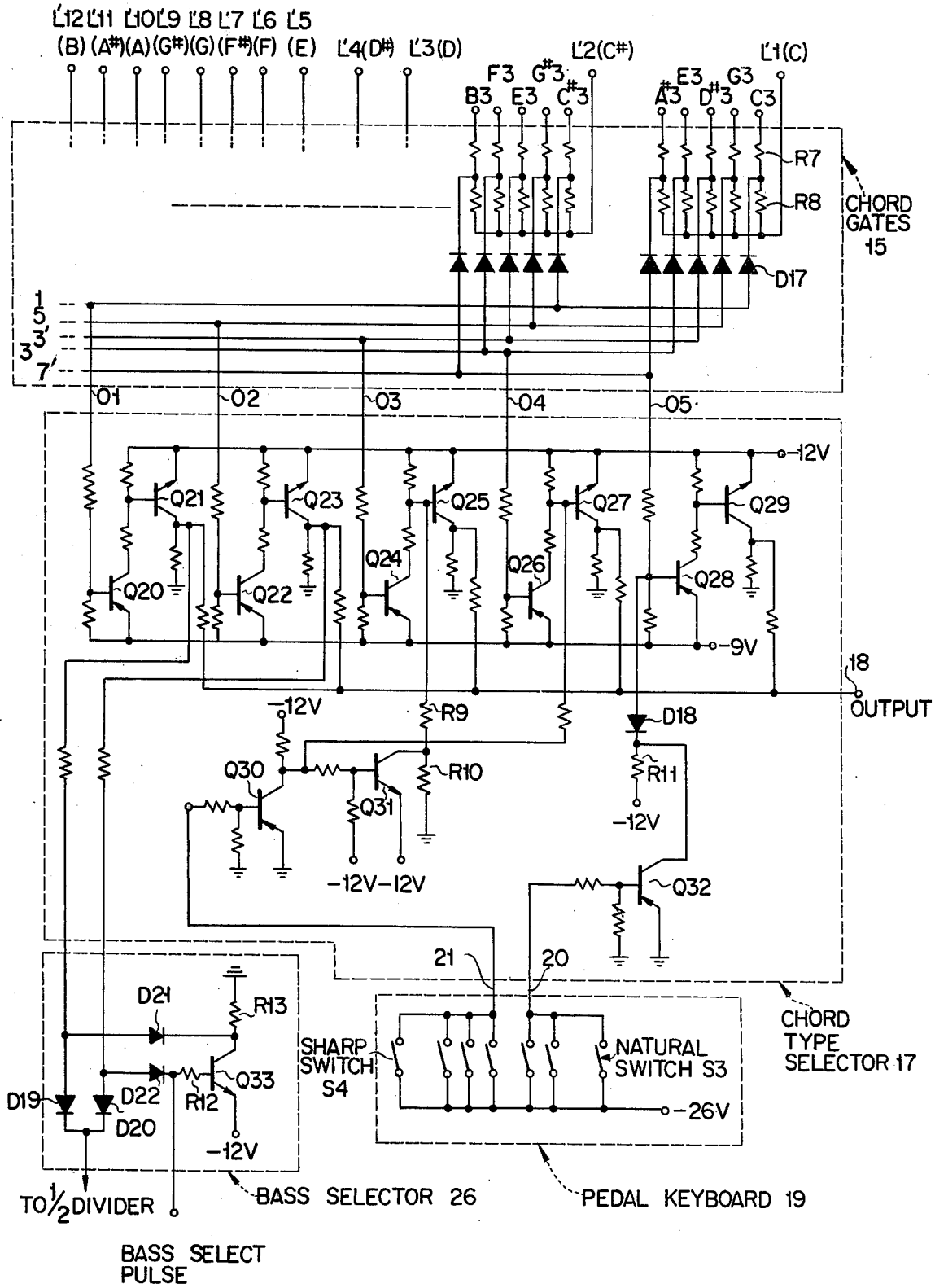
FIG. 3 shows exemplary circuits of the chord gate circuitry, chord type selector, pedal keyboard and bass selector of FIG. 1.

As shown in FIG. 3, each gate of the chord gate circuitry 15 may be constituted by five resistors R7, five resistors R8 and five diodes D17. The anodes of the diodes D17 are coupled to the −9V power source of the chord type selector 17, so that the diodes D17 are normally reverse-biased. If a detection output of about −26V appears at any one of the output lines L1' to L12' of the root note detector 16, the diodes D17 coupled to the output line are forward-biased, thus supplying tone signals to the output lines 01 to 05. For example, if a detection output appears at the output line L1' of the root note detector 16, root note C3, fifth note G3, minor third note $D^{\#3}$, third note E3 and seventh minor are supplied to the output line 01 through a root note line 1, to the output line 02 through a fifth note line 5, to the output line 03 through a minor third note line 3', to the output line 04 through a major third note line 3 and to the output line 05 through a minor seventh note line 7' of the chord gate circuitry 15, respectively.

The root note supplied to the output line 01 is transferred through transistors Q20 and Q21, and the fifth note supplied to the output line 02 is transferred through transistors Q22 and Q23, both to the output line 18 of the chord type selector 17 and to the bass selector 26. But the minor third note, the major third note and the minor seventh note supplied respectively to the output lines 03, 04 and 05 are transferred to the output line 18 under control of the pedal keyboard 19.

The pedal keyboard 19 has natural switches S3 which apply −26V on the output line 20 when actuated by corresponding natural pedals (not shown) and sharp swithces S4 which apply −26V on the output line 21 when actuated by corresponding sharp pedals (not shown). If any one of the sharp switches S4 is actuated, a transistor Q30 is driven by the −26V power source from cutoff into saturation. By saturation of the transistor Q30, a transistor Q31 is also driven into saturation. On the other hand, if any one of the natural switches S3 is actuated, a transistor Q32 is driven by the −26V power source from cutoff into saturation.

The minor third note supplied to the output line 03 is to be transferred to the output line 18 through a transistor Q24 and a transistor Q25. If neither the natural nor sharp pedals are actuated, the transistor Q25 has its base applied with ground potential by a resistor R9 and a resistor R10 which is grounded. As a result, the transistors Q25 is driven into saturation, thereby not to transfer the minor third note to the output line 18. On the other hand, the third note supplied to the output line 04 is transferred to the output line 18 through transistors Q26 and Q27 because the transistor Q27, whose base is coupled to the −12V collector power source of the transistor Q30, is not driven into saturation. But the minor seventh note supplied to the output line 05 cannot be transferred to the output line 18 through a transistor Q28 and a transistor Q29, since the transistor Q28 having its base coupled to a −12V power source through a diode D18 and a resistor R11 is driven into saturation and thus the succeeding transistor Q29 is also driven into saturation. That is, if neither the natural nor sharp pedals are actuated on the pedal keyboard 19, only root, fifth and major third notes, i.e. major chord constituent notes are transferred to the output line 18.

If only a natural pedal or pedals are actuated, the transistor Q32 is driven into saturation, thus reverse-biasing the diode D18. As a result, the transistor Q28 cannot be driven into saturation by the −12V power source through the diode D18 and the resistor R11, and couples the minor seventh note on the output line 05 to the output line 18 through the transistor Q29. Namely, in case only the natural pedals are actuated, the output line 18 receives root, fifth, major third and minor seventh notes, i.e. dominant seventh chord constituent notes.

If only a sharp pedal or pedals are actuated, the transistor Q27, not the transistor Q25, is driven into saturation. As a result, the minor third note on the output line 03, not the major third note on the output line 04, is coupled to the output line 18. Thus, in this case, the output line 18 is supplied with root, fifth and minor third notes, i.e. minor chord constituent notes.

If a natural pedal or pedals and a sharp pedal or pedals are actuated at the same time, the transistor Q27 is driven into saturation. Consequently, root, fifth, minor third and minor seventh notes, i.e. minor seventh chord constituent notes, respectively on the output lines 01, 02, 03 and 05 are transferred to the output line 18.

As mentioned above, the root and fifth notes commonly contained in all the chords are coupled to the bass selector 26. The root note and the fifth note are coupled to the ½ frequency divider 29 through a diode D19 and a diode D20, respectively. The anode of the diode D20 is connected to the base of a transistor Q33 through a diode D22 and a resistor R12, and the emitter of the transistor Q33 is connected to a −12V power source and the collector thereof is connected to ground through a resistor R13. The anode of the diode D19 is connected to the collector of the transistor Q33 through a diode D21. A bass note select pulse is applied to the junction between the diode D22 and the resistor R12.

The output signal of the chord type selector 17 is a rectangular wave having 0 volt-level and −12 volt-level. Similarly, the base note select pulse has 0 volt-level and −12 volt-level. For this reason, while the bass note select pulse is at −12 volt-level, the diode D22 is forward-biased by the tone signals, and the diode D21 is reverse-biased by the tone signals. In consequence, only the root note is coupled to the frequency divider 27 through the diode D19. On the other hand, while the bass note select pulse maintains 0 volt-level the transistor Q33 is driven in saturation. During this period the cathode of the diode D21 remains at a potential of about 31 12V, and the diode D21 is therefore forward-biased. Since the diode D22 is not forward-biased throughout this period, the fifth note is coupled to the frequency divider 27. Thus, as shown in FIG. 4, the root note and fifth note are alternately transferred to the frequency divider 27 in response to the base note select pulse.

What is claimed is:

1. An electronic organ comprising:
a manual keyboard having keys;
tone generators;
keyer means coupled to said tone generators and responsive to key actuation on said keyboard so as to selectively derive at least one tone signal from said tone generators;
automatic chord constituting means coupled to said tone generators and responsive to actuation of a key on said keyboard so as to selectively derive from said tone generators tone signals of notes constituting a chord whose root note is the note of the key being actuated, said automatic chord constituting means including:
root note detector means for detecting the root note of a chord which is played on said keyboard;
chord producing means coupled to said tone generators and to said root note detector means and responsive to said root note detector means for selectively deriving from said tone generators tone signals of notes constituting a plurality of chords having the root note; and
chord type selecting means coupled to said chord producing means for selecting tone signals from said chord producing means for constituting one type of the chords; sound producing means; and
selector switch means for selectively coupling one of said keyer means and said automatic chord constituting means to said sound producing means.

2. The electronic organ according to claim 1 wherein said root note detector detects the root note of a chord based on a lower note preference order.

3. The electronic organ according to claim 1 wherein said root note detector detects the root note of a chord based on a higher note preference order.

4. The electronic organ according to claim 1 further comprising a rhythm gate means coupled between said selector means and said sound producing means, said rhythm gate means being enabled in a rhythm pattern.

5. The electronic organ according to claim 1 wherein the chord types are major, minor, seventh and minor seventh chords.

6. The electronic organ according to claim 1 wherein said chord type selecting means comprises a pedal keyboard having natural pedals and sharp pedals and selects a first type of chord when none of the natural sharp pedals is actuated, a second type of chord when only the natural pedal is actuated, a third type of chord when only the sharp pedal is actuated, and a fourth type of chord when both the natural and sharp pedals are concurrently actuated.

7. The electronic organ according to claim 6 wherein the first type of chord is a major chord.

8. The electronic organ according to claim 6 wherein the first type of chord is a major chord, the second type of chord is seventh chord, the third type of chord is a minor chord, and the fourth type of chord is a minor seventh chord.

9. The electronic organ according to claim 1 further comprising means coupled to receive a first tone signal having a first note and a second tone signal having a second note from said automatic chord constituting means for coupling the first and second tone signals alternately to said sound producing means.

10. The electronic organ according to claim 9 wherein the first note and the second note are root note and fifth note, respectively.

11. The electronic organ according to claim 9 further comprising gate means coupled between said sound producing means and said means for coupling the first and second tone signals alternately to the sound producing means, said gate means being enabled in a rhythm pattern.

12. An electronic organ comprising:

a manual keyboard having keys;

a pedal keyboard having natural pedals and sharp pedals;

tone generators;

keyer means coupled to said tone generators and responsive to key actuation on said manual keyboard so as to selectively derive at least one tone signal from said tone generators;

root note detector means for detecting the root note of a chord which is played on said manual keyboard;

chord producing means coupled to said tone generators and said root note detector means for selectively deriving from said tone generators tone signals of notes constituting a plurality of chords having the root note of the chord being played on the manual keyboard;

chord type selecting means coupled to said chord producing means for selecting one type of the chords from said chord producing means in response to a depression mode of said pedal keyboard;

sound producing means; and selector switch means for coupling one of said keyer means and said chord type selecting means to said sound producing means.

13. The electronic organ according to claim 12 wherein said chord type selecting means selects a first type of chord when none of said natural and sharp pedals is actuated, a second type of chord when only said natural pedal is actuated, a third type of chord when only said sharp pedal is actuated, and a fourth type of chord when both said natural and sharp pedals are concurrently actuated.

14. The electronic organ according to claim 12 wherein said root note detector means comprises means for causing said root note detector means to detect the lowest or highest note of the keys being actuated on said manual keyboard when said selector means couples said chord type selecting means to said sound producing means.

15. The electronic organ according to claim 13 wherein the first type of chord is a major chord.

16. The electronic organ according to claim 13 wherein the first type of chord is a major chord, the second type of chord is a seventh chord, the third type of chord is a minor chord, and the fourth type of chord is a minor seventh chord.

17. The electronic organ according to claim 12 further comprising means coupled to receive a first tone signal having a first note and a second tone signal having a second note from said chord producing means for coupling the first and second tone signals alternately to said sound reproducing means.

18. The electronic organ according to claim 17 further comprising gate means coupled between said sound producing means and said means for coupling the first and second tone signals alternately to said sound producing means, said gate means being enabled in a rhythm pattern.

19. The electronic organ according to claim 17 further comprising frequency dividing means coupled between said sound producing means and said means for coupling the first and second tone signals alternately to said sound producing means.

20. The electronic organ according to claim 17 wherein the first and second notes are root and fifth notes, respectively.

21. The electronic organ according to claim 12 further comprising a rhythm gate means coupled between said selector means and said sound producing means, said rhythm gate means being enabled in a rhythm pattern.

22. The electronic organ according to claim 21 wherein said rhythm gate means has a percussive envelope providing function.

23. The electronic organ according to claim 18 wherein said gate means has a percussive envelope providing function.

* * * * *